US011840106B2

(12) United States Patent
Cassibba et al.

(10) Patent No.: US 11,840,106 B2
(45) Date of Patent: Dec. 12, 2023

(54) SLIDING BOARD INCLUDING ON ITS VISIBLE FACE A DECORATED COMPOSITE MATERIAL AND ASSOCIATED METHOD

(71) Applicant: SKIS ROSSIGNOL, Saint-Jean de Moirans (FR)

(72) Inventors: Emanuele Cassibba, Sillingy (FR); Grégory Merle, Aix les Bains (FR); Jacky Christoud, Saint Cassien (FR); Thierry Monnet, Izeaux (FR); Frédéric Leclercq, Magland (FR)

(73) Assignee: SKIS ROSSIGNOL, Saint-Jean de Moirans (FR)

( * ) Notice: Subject to any disclaimer, the term of this patent is extended or adjusted under 35 U.S.C. 154(b) by 0 days.

(21) Appl. No.: 17/510,681

(22) Filed: Oct. 26, 2021

(65) Prior Publication Data

US 2022/0126616 A1 Apr. 28, 2022

(30) Foreign Application Priority Data

Oct. 28, 2020 (FR) ..... 2011029

(51) Int. Cl.
*B41M 3/12* (2006.01)
*A63C 5/00* (2006.01)

(52) U.S. Cl.
CPC ..... *B41M 3/12* (2013.01); *A63C 5/003* (2013.01)

(58) Field of Classification Search
CPC ..... B41M 3/12; B41M 5/025; B41M 5/0256; B41M 5/03; A63C 5/003; A63C 5/124; B44C 5/005
See application file for complete search history.

(56) References Cited

U.S. PATENT DOCUMENTS 5,718,792 A * 2/1998 Goode ..... A63C 11/22 156/240
6,004,900 A * 12/1999 O'Brien, III ..... B41M 5/52 503/227

FOREIGN PATENT DOCUMENTS

DE 10249223 A1 5/2004
EP 0774365 A1 5/1997
EP 1829699 A1 9/2007
(Continued)

OTHER PUBLICATIONS

English translation of DE10249223.*
(Continued)

*Primary Examiner* — Sonya M Sengupta
(74) *Attorney, Agent, or Firm* — MARSHALL, GERSTEIN & BORUN LLP

(57) ABSTRACT

A method for decorating a sliding board including on its visible part, a composite material formed of a fibrous layer coated with hardenable resin, includes preparing a transfer film that includes a face covered with a pattern constituted of an arrangement of grains of at least one type of ink. The ink includes colourants and a crosslinked polymer. The method also includes positioning the face of the transfer film covered with the pattern on all or some of the external surface of the composite material, applying pressure and temperature conditions generating the softening or/then hardening of the resin to as to incrust the grains of the pattern in the superficial layer of the composite material while conserving the arrangement of the grains, and peeling the transfer film.

8 Claims, 6 Drawing Sheets

(56) References Cited

FOREIGN PATENT DOCUMENTS

EP 2636531 A1 9/2013

OTHER PUBLICATIONS

English translation of EP0774365.*
English translation of EP1829699.*
English translation of EP2636531.*
English translation of the written opinion of EP21204870.6.*
French Search Report issued in French Patent Application No. 2011029 dated Jul. 7, 2021.

* cited by examiner

SLIDING BOARD INCLUDING ON ITS VISIBLE FACE A DECORATED COMPOSITE MATERIAL AND ASSOCIATED METHOD

TECHNICAL FIELD

This disclosure relates to the field of boards for sliding on snow or on water, and in particular downhill skiing, cross-country skiing or ski touring, or also snowboards or wakeboards.

This disclosure relates more specifically to a sliding board including on its visible face, a decorated composite material, as well as the associated manufacturing method.

The disclosed embodiments have the advantage of allowing the implementation of a décor on the sliding board without integrating an additional layer supporting the décor. In the case of sliding boards, this implementation allows in particular an interesting weight saving.

BACKGROUND OF THE DISCLOSURE

Generally, a ski is identified thanks to the different markings and patterns present on the visible face of the ski. As an example, it is possible to identify the brand of the ski, its model, as well as different information relating to the size of the ski and to the adjustment of the members for retaining the shoe. Moreover, the décor allows to give an advantageous aesthetic appearance.

The choice of the décor is determinant for the Applicant since it allows to attract the attention of the user and of the public to its product. Moreover, it is also necessary to consider the wear stresses (friction, UV, temperature, etc.) that the décor suffers, in order to ensure that it does not disappear over time.

In addition, the production of numerous models with different dimensions and properties implies to find a decoration method allowing to easily modify the pattern and the markings of the décor without creating excess costs.

Among the current methods, the transfer of a pattern by ink sublimation is known.

For example, document EP 0 774 365 proposes a method for decorating a sliding board made of hardened composite material. A transparent plastic material layer is decorated beforehand on its lower face by transferring sublimable inks, then is thus glued on the surface of the composite material. Yet, the product obtained comprises an additional layer which adds to the overall weight of the sliding board. Yet, this is not sought in the scope of sliding boards, which must always be lighter to improve their performance on the snow.

U.S. Pat. No. 6,004,900 describes a sport item, typically a hockey stick, comprising an outer layer made of hardened composite material, the resin of which contains clear colour pigments. The décor is printed on the item by sublimation of an ink in the superficial layer of the composite material. The sublimation takes place during the application of certain pressure and temperature conditions of around 160 to 180° C., allowing the ink to temporarily pass to the gaseous state. However, during its sublimation, the ink in the gaseous state diffuses in the resin, such that the contours of the décor obtained are not clean. An example of diffusing the ink is illustrated in FIG. 1 below, on which a continuous ink layer 31 is observed, which gradually melts in the resin 23, a sign that the ink 31 diffuses in the resin 23. In addition, the method requires to mix clear colour pigments with the resin beforehand, without which the sublimed ink lacks contrast. Yet, this additional step complexifies the method. It is moreover impossible to obtain white colour planes directly.

U.S. Pat. No. 5,718,792 presents a method for decorating a ski pole made of hardened composite material. To do this, a decorated sheet pre-printed with the sublimable ink is applied on the surface of the pole. The assembly is heated, for example, to a temperature of around 210° C. for 60 to 80 seconds, to allow to passage of the ink directly to the gaseous state by sublimation of the décor in the pole. However, the décor transferred does not have a clean appearance, as the ink diffuses in the resin, particularly in the case of a curved surface, since the positioning of the decorated sheet pre-printed on the pole is a difficult step which can barely be reproduced. The high temperatures applied in the methods implementing a sublimation are incompatible with applications on items including heat-sensitive materials, like for example, polyethylene sliding soles on a ski.

Moreover, there is another method allowing to decorate the surface of a sliding board, namely printing by screen printing. This method consists of directly printing the pattern on the surface of the sliding board thanks to stencils mounted on frames. However, the pattern remains on the surface of the item and is consequently very fragile faced with external aggressions. To prevent the pattern disappearing too quickly, it is known to cover the printed surface of the sliding board with a layer of varnish. This layer however forms an excess thickness which contributes to increasing the overall weight of the sliding board.

The technical problem to be resolved by the present embodiments is therefore to develop a method for manufacturing a sliding board for which the décor printed on the composite material of the sliding board forms the least excess thickness as possible, is clean and does not diffuse in the resin, while being resistant to wear and to external aggressions.

SUMMARY OF THE DISCLOSURE

To resolve this problem, the Applicant has developed a method for decorating a sliding board including on its visible part, a composite material formed of a coated fibrous layer of hardenable resin, said method comprising the following steps:

- preparing a transfer film comprising a face covered with a pattern constituted of an arrangement of grains of at least one type of ink, said ink comprising colourants and a crosslinked polymer,
- positioning the face of the transfer film covered with the pattern on all or some of the external surface of the composite material,
- applying pressure and temperature conditions generating the softening or/then the hardening of the resin so as to incrust at least partially the grains of the pattern in the superficial layer of the composite material while conserving the arrangement of the grains prepared on the transfer film, and
- peeling the transfer film.

In the contemplated embodiments, the "hardenable" resin can be a resin commonly qualified as thermosetting, i.e. which hardens by crosslinking when the temperature and pressure conditions are applied. Alternatively, the resin can be a thermoplastic resin, which hardens during its cooling after having been softened by application of suitable pressure and temperature conditions.

The resin therefore has a dual function of rigidifying the composition and as an element of receiving the décor. It is therefore no longer necessary to add additional decorated layers, which allows to achieve an interesting thickness and weight saving.

In other words, the method allows to transfer a pattern on a sliding board without change of state of the ink and therefore without diffusion, and without deformation or loss of cleanliness of the pattern. To do this, the pattern to be transferred onto the sliding board is printed on a transfer film by a screen printing- or inkjet-type printing. Preferably, the ink used is initially in the liquid state.

More specifically, the method therefore comprises a step of crosslinking the polymer composing the ink. The crosslinking is initiated by an inflow of external energy. For example, the inflow of energy can come into contact with the ambient humidity, the increase in temperature or exposure to UV light.

Advantageously, the ink in solid form obtained has a structure which has no melting point, does not soften, but is degraded or carbonised when it is heated beyond a certain temperature. This degradation or carbonisation temperature is greater than the conditions of the method for manufacturing the sliding board.

Advantageously, the transfer film ideally has at least one of the following properties.

Preferably, the transfer film is deformable, i.e. that it can be folded and/or stretched to be adapted to the three-dimensional geometry of the external surface of the composite material. In practice, the printed transfer film is positioned by folding it to adapt it to the three-dimensional external surface of the composite material.

For example, the transfer film is made from a material chosen from among polyolefins. This material family has good lightness and cracking and tearing resistance properties.

According to a favoured embodiment, the adhesion force between the grains and the film is sufficiently high such that the pattern does not move on the film during the movement and the positioning of the transfer film in contact with the resin. On the contrary, the adhesion force between the ink grains and the resin is preferably greater than the adhesion force between the ink grains and the transfer film. Thus, the ink grains are detached from the film during peeling and remain embedded in the resin.

In practice, the abovementioned adhesion forces are obtained thanks to the roughness present on the surface of the transfer film.

Moreover, the softening temperature of the transfer film is advantageously greater than the temperature generating the softening or/then the hardening of the resin to avoid deformations of the pattern or the incrustation of a portion of the transfer film in the resin.

In practice, the method for decorating the sliding board can be done in two ways. The method can comprise a step of positioning the composite material in a mould, the pressure and temperature conditions generating the softening or/then the hardening of the resin being then applied to said mould.

The mould corresponds, for example, to the mould in which the sliding board is assembled. In this case, the temperature generating the softening or/then hardening of the resin applied during the moulding is less than or equal to 120° C., to not degrade the temperature-sensitive elements, like for example polyethylene ski soles.

In a variant, the pressure and temperature conditions are applied only on the layer of composite material, then the assembly in a mould is done secondly.

According to a second aspect, the disclosed embodiments include a sliding board obtained through the method according to the first aspect of the disclosed embodiments. The sliding board includes on its visible face, a decorated composite material, formed of a hardened resin coated fibrous layer.

Such a sliding board is characterised in that said decorated composition material comprises a pattern composed of an arrangement of grains of at least one type of ink, said ink comprising colourants and a crosslinked polymer, these grains being incrusted in the superficial layer of the hardened resin of the composite material.

More specifically, a composite material is composed of a hardened resin coated fibrous layer. According to the technology used to make the composite material, the resin can be a thermoplastic resin, which hardens when it is cooled, or a thermosetting resin which hardens by phenomena of chemical reactions. In practice, before hardening, a thin layer of resin remains supernatant with respect to the fibrous layer and constitutes the superficial layer in which the grains can be incrusted.

In the contemplated embodiments, "incrusted" means that a portion of the volume of the ink grain is surrounded by resin. In other words, a significant portion, ideally most, of the external surface of the grain is in contact with the resin. For example, the grain can be completely embedded and isolated in the resin or its upper surface can exceed the open air or also at least one of its lateral zones can be contiguous with another grain. In any case, there is still a certain continuity of the resin, from the fibrous layer of the composite material, to the external surface, in order to block the ink grains. Furthermore, the ink grains do not enter inside the fibrous layer, which allows to conserve the mechanical resistance properties of the composite material.

Thus, the incrusted ink grains are specific and non-diffused element, like pixels, and it is possible to distinguish them under a microscope. They are thus presented in isolated form or in the form of grain aggregates surrounded by resin.

The décor is incrusted in a very low resin thickness. Thus, in the case where the ink grains are totally covered with resin, they remain visible through transparency and have clean and precise contours. In addition, the décor is protected by the resin which surrounds it and resists the mechanical and chemical aggressions. This also allows a better resistance to abrasion and to removal.

Moreover, the sliding board does not have excess thickness linked to the addition of décor, which allows to increase lightness with respect to the sliding boards of the state of the art.

In practice, the polymer constituting the ink is chosen from among the group including polyacrylates, polyacrylics and polyurethanes. Inside the décor affixed to the sliding board, these polymers are in crosslinked form, such that the ink grains are in the solid state and adopt a three-dimensional configuration. Contrary to the sliding boards of the state of the art, all the colours of colourant can be used, even white, while conserving a sufficient contrast with the resin to distinguish the décor.

According to a characteristic of the disclosed embodiments, the number of grains present per surface unit of the surface of the decorated composite is comprised between 2500 and 640000 dots per square inch, preferably between 10000 and 160000, which corresponds to a linear resolution comprised between respectively 50 and 800 dpi or dots per inch and 100 and 400 dpi or dots per inch.

The suitable surface unit corresponds to a square, of which the sides are 2.54 cm. This resolution value can also be expressed in "dpsi" or number of dots per square inch, which derives from the measuring unit dpi or "dots per inch", commonly used to define the resolution of a printer or of a scanner. In practice, the number of grains present per surface unit of the surface of the decorated composite is connected to the resolution of the device used to create the décor on the sliding board, since the printing of the decor is done with grains in the solid state, which cannot pass to the liquid state, nor to the gaseous state. Consequently, there is no diffusion of the grains in the resin, which contributes to the clean appearance of the décor.

According to a second characteristic of the disclosed embodiments, the ratio of the surface occupied by the grains on a unit surface, is comprised between 20 and 75%, advantageously between 25% and 50%. This coverage ratio guarantees a sufficient maintaining of the grains within the superficial layer of hardened resin as well as a good protection of grains faced with external aggressions. The greater the coverage ratio is, the more concentrated the colour is, and appears with more intensity and contrast. On the contrary, the ink grains are more firmly incrusted when this ratio does not exceed a maximum value.

According to a third characteristic of the disclosed embodiments, an ink grain has a diameter, or generally a greater dimension comprised between 10 and 100 μm. These dimensions are chosen such that the thickness of the grain is ideally smaller than the thickness of supernatant resin, in order to be correctly surrounded by resin. The diameter is also chosen such that the grain is sufficiently large to be correctly distinguished through the resin layer. Moreover, the dimensions are also chosen to guarantee the aesthetic appearance of the décor and to obtain the best resolution as possible within the limits of the constraints mentioned above.

In practice, the pattern can be printed on the three-dimensional external surface of the composite material. Thus, for a sliding board, the pattern covers the upper face of the sliding board. In a variant, the pattern is not limited to the upper level of composite material of the sliding board, but it can also cover the lateral surfaces of the composite material of the sliding board, which contributes to improving the aesthetic appearance. Moreover, the sliding board can have, on its upper surface, forms in relief, where the pattern can be affixed without difficulty.

BRIEF DESCRIPTION OF THE FIGURES

As the way to implement the disclosed embodiments, as well as the advantages which arise from it, will emerge from the description of the embodiments below, in accordance with the appended figures in which.

DETAILED DESCRIPTION

FIGS. 2, 3 and 6-10 are not represented to scale to facilitate the understanding of the reader. In particular, the thickness of the supernatant resin layer 13 is exaggerated to illustrate the phenomena which occur within this layer. In particular, the form of the ink grains 11, 21 is schematised by a mainly rectangular form, which is not necessarily representative of the actual form of the grains 11, 21.

Figure 2:
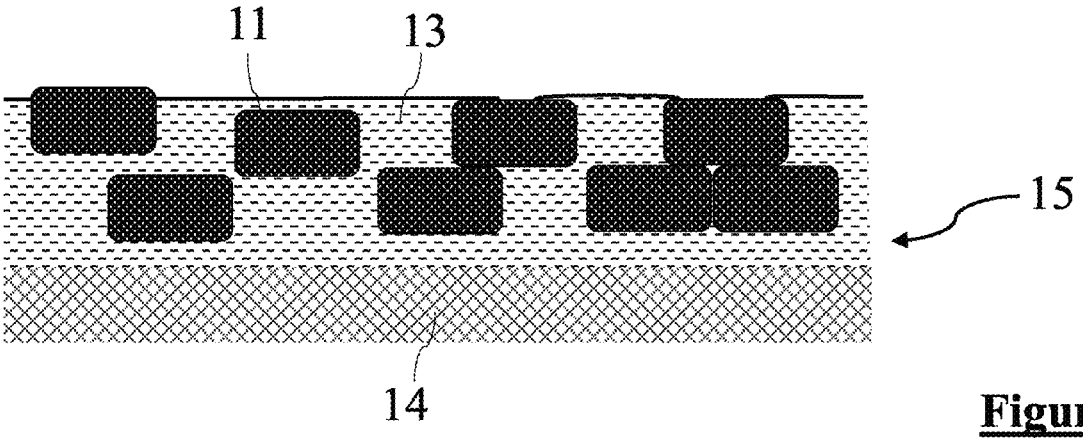
FIG. 2 is a median transverse cross-section of the upper portion of the sliding board including on its visible face, a decorated composite material comprising one single type of ink grain.
Figure 3:
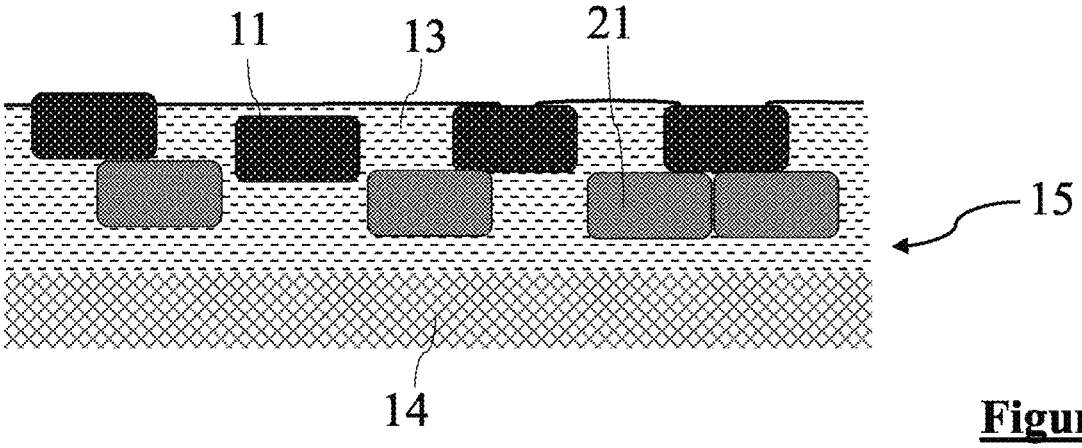
FIG. 3 is a median transverse cross-section of the upper portion of a sliding board including on its visible face, a decorated composite material comprising two types of ink grain.

FIGS. 2 and 3 illustrate a median transverse cross-section of the upper portion of a sliding board including on its visible face, a decorated composite material 15. Such a composite material 15 is for example found on the upper portion of a sliding board, as a reinforcement. The upper face of the composite material 15 is visible and therefore appears decorated.

A composite material 15 is typically formed of a fibrous layer 14 made of glass fibre, carbon, basalt or long or short, one-directional or oriented natural fibres, or also constituted of a non-woven material, for example polyester thread-based. In any case, the fibrous layer 14 is impregnated with thermosetting resin 13, for example an epoxy, or thermoplastic resin, like a polyamide resin. The resin 13 has a supernatant portion above the fibrous layer 14. This supernatant resin portion 13 has a thickness of a few micrometres.

The décor is presented in the form of an arrangement of ink grains 11, 21 embedded in the resin 13 on a thickness less than 10 μm. The décor can have one or more layers of one or more types of grains 11, 21.

As an example, FIG. 2 only presents one single type of grains 11, distributed over two superposed layers, corresponding to an ink of one single given colour. FIG. 3 also presents two superposed layers. The first layer is composed of a first type of grains 21 and the second layer is composed of another type of grains 11, typically of different colours.

Figure 4:
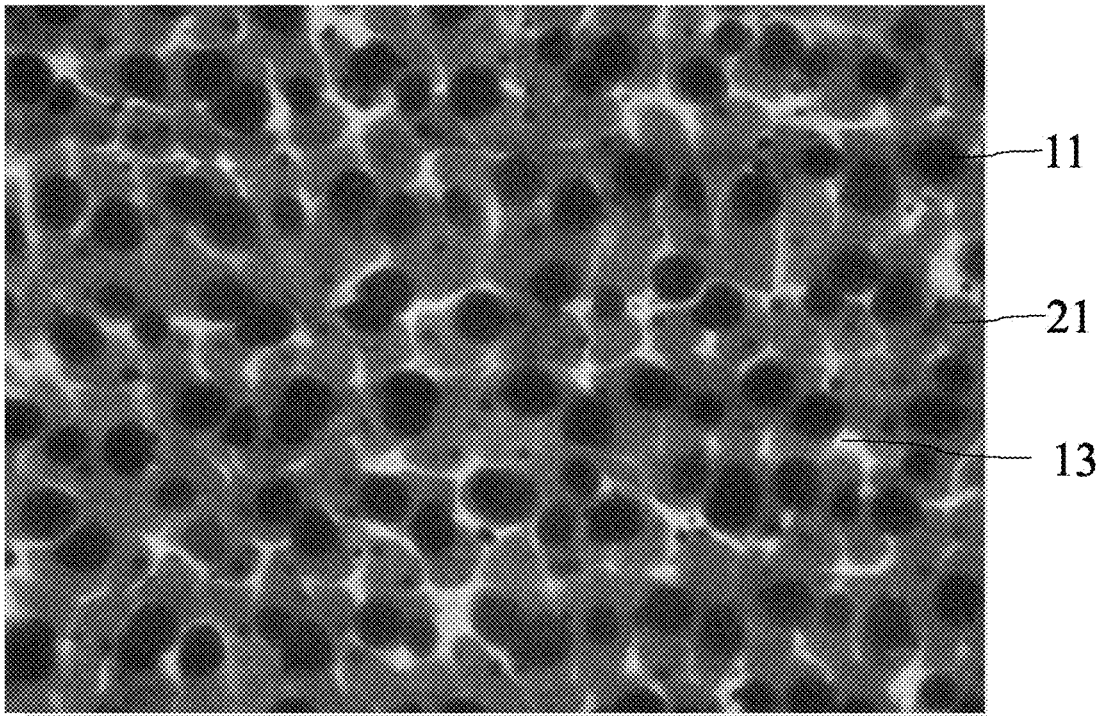
FIG. 4 is a photograph taken with a microscope, with a magnification comparable to the magnification of FIG. 3, of the surface of a sliding board.

Such as illustrated in FIG. 4, the grains 11, 21 have a substantially rounded, solidified and/or dried droplet appearance.

They can be isolated and completely surrounded in the resin or contiguous with one or more other grains 11, 21 of the same layer or of an upper or lower layer. The upper portion of the grain 11 can also emerge partially or totally to open air. Generally, the décor does not appear as an excess thickness by touch as the resin is predominant on the surface, such that the surface remains smooth and relatively homogenous.

In the case where several layers have been superposed, it is difficult to perceive the spaces between the particles, but with a sufficient magnification, for example obtained with a microscope, like in FIG. 4, the distinctive form of the grains 11, 21 can be highlighted. It is also easier to see these grains 11, 21 at the edge of the décor, as in this place there are often less superposed decorated passes.

The type of a grain 11, 21 varies according to the ink used, typically the nature of the polymer or of the colourant can vary. In any case, the ink used is an ink in solid and non-sublimable form, which does not pass to the liquid state, nor to the gaseous state when it is heated. On the contrary, if the ink composing a grain 11, 21 is heated, this is irremediably degraded, it even burns and carbonises. In particular, the ink is, for example, composed of a crosslinked polyurethane, polyacrylate or polyacrylic polymer.

This type of ink can integrate all types of colourants, even white, contrary to the sublimable inks of the state of the art where there is no white.

Figure 1:
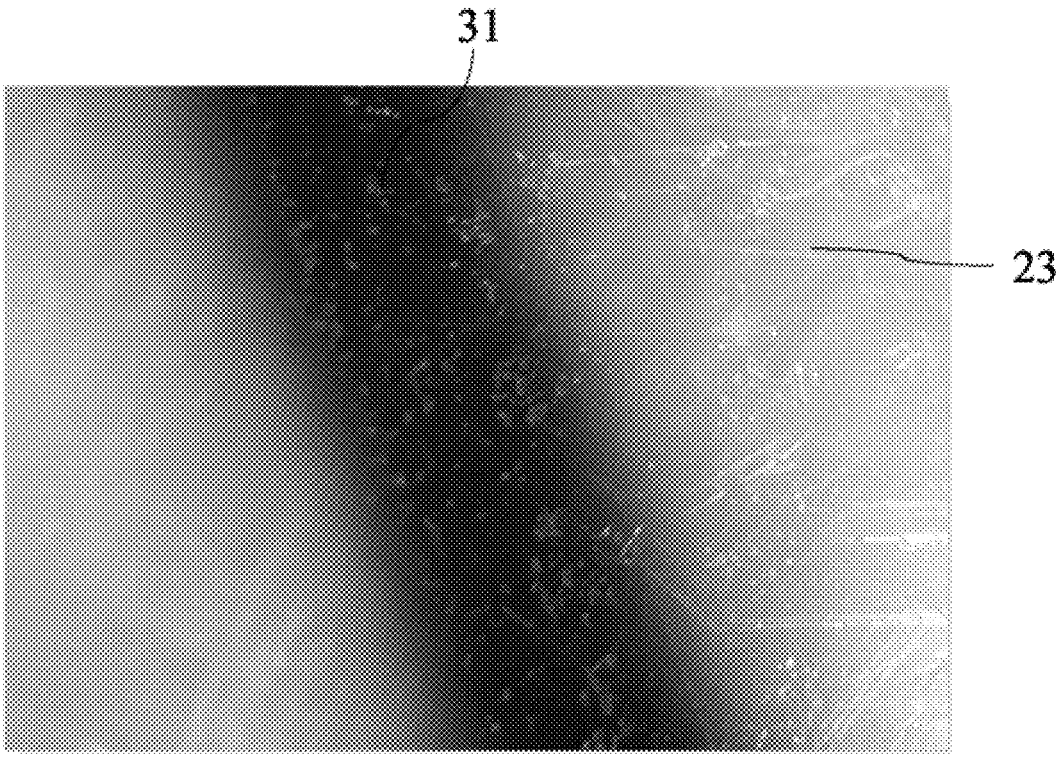
Prior art Figure 1
FIG. 1 is a photograph, taken with a microscope, of the upper portion of a sliding board of the prior art, decorated by sublimation of an ink in the resin.

The décor obtained is precise and clean, since the grains 11, 21 do not diffuse in the resin. FIGS. 1 and 4 allow to compare a product obtained thanks to the principle of the disclosed embodiments, which can be seen in FIG. 4, and a product obtained by sublimation of ink in the resin, which can be seen in FIG. 1.

In FIG. 4, the clean contours of the grain arrangement 11, 21 surrounded by the resin 13 is distinguished. While in FIG. 1, no grains are observed, but a continuous layer of ink 31, which gradually melts in the resins, a sign that the ink 31 diffuses in the resin 13.

The sliding board can thus be decorated on all its faces and even on surfaces at particular geometries, like curved surfaces. For example, in the case where the composite reinforcement is extended laterally on the ski flanks, it is possible to decorate the top and the flanks of a ski continuously, without losing precision or deformation of the décor at the level of the angles or curves.

Advantageously, an increase of 40 g on a 550 g cross-country ski, has been achieved by the Applicant by replacing a décor by inputting material by the decoration method of the disclosed embodiments.

Figure 5:
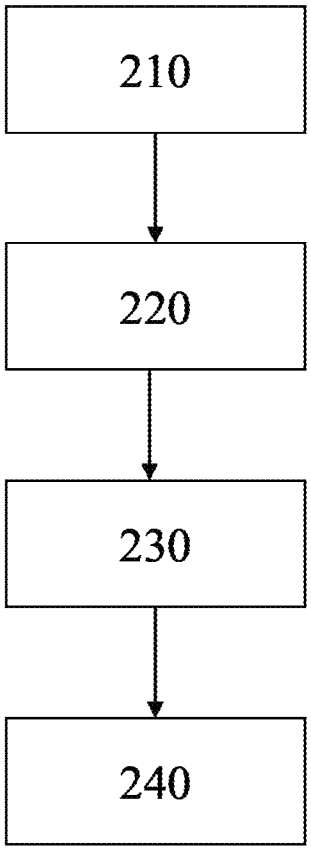
FIG. 5 is a flowchart of the chain of the steps of the methods described herein.

The method allowing to obtain such a sliding board is illustrated in FIG. 5 and comprises four successive steps.

Figure 6:
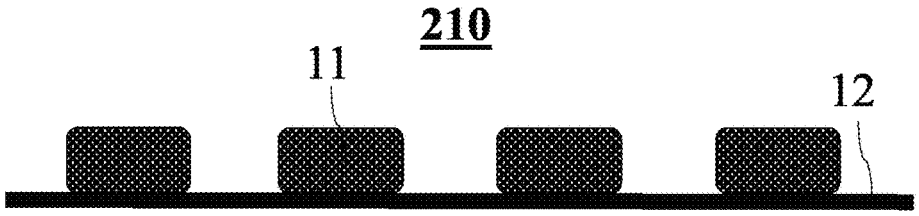
FIG. 6 is a cross-sectional representation of the printed transfer film during the first step of the method of FIG. 3, according to a first embodiment.
Figure 7:
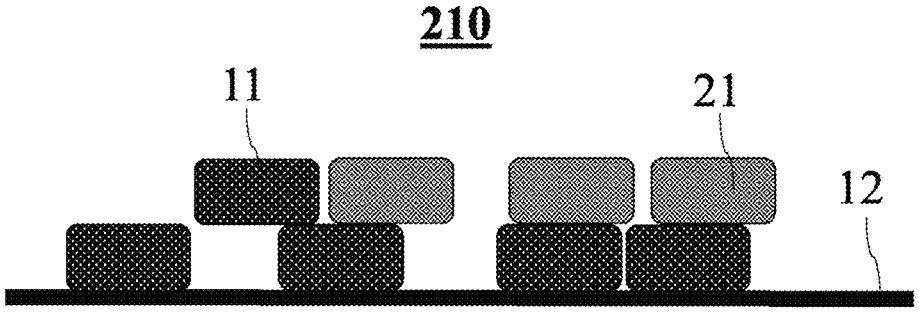
FIG. 7 is a representation similar to FIG. 6, according to a second embodiment.

The first step 210, illustrated in FIGS. 6 and 7, is the preparation of a transfer film 12. The transfer film 12 is a thin sheet, made of a flexible and deformable material, typically belonging to the polyolefin family.

The pattern of the décor is printed on the transfer film 12, with the film flat.

Advantageously, the transfer film 12 is chosen to be able to deform without breaking during transport and implementation in the mould.

For three-dimensional sliding boards the surface of which includes edges delimiting separate zones, not necessarily coplanar, there is an advantage in using a transfer film 12 which has a stretching capacity. Typically, the transfer film 12 has an elongation to cracking comprised between 60 and 100% of its initial surface. Otherwise formulated, the transfer film 12 can be extended up to twice its initial size before cracking.

Furthermore, the transfer film 12 comprises at least one face having a roughness intended to mechanically retain the grains 11, 21 of the décor. The roughness is chosen to allow to hold the pattern in place on the transfer film 12, without migration during the movement and the positioning of the transfer film 12 on the surface of the resin, all the more so the decorated face of the transfer film 12 is oriented downwards during the moulding of the board.

In addition, the roughness is also chosen to limit the contact surface with the grains 11, 21, such that these transfer into the resin 13 when a predetermined pressure is applied on the transfer film 12. Typically, the average roughness Ra is comprised between 2 and 5 μm, preferably close to 3 μm. The average roughness Ra is obtained by calculating the average difference between the peaks and the troughs of the roughness profile of the transfer film 12. The maximum roughness Rz corresponds to the absolute vertical difference between the maximum height of the peaks and the maximum depth of the troughs over a predetermined length. Preferably, the maximum roughness Rz is comprised between 15 and 30 μm, typically close to 23 μm.

Two different techniques can be used to perform the printing of the pattern: printing by inkjet or screen printing.

Printing by inkjet is performed by a printer comprising printing heads allowing to deposit liquid ink drops on the surface of the transfer film 12 with a linear resolution comprised between 200 and 500 dpi, typically 360 dpi, that is around 130000 drops per square, of which the sides are 2.54 cm, that is around 20000 drops per $cm^2$. The diameter of the drops deposited is comprised between 10 and 100 μm, typically 24 μm. The dimensions of the drops and of the grains can be measured by traditional image analysis techniques from images similar to that of FIG. 4.

The ink generally contains a photopolymerising agent. After deposition of ink drops on the transfer film 12, these are exposed to UV light allowing to initiate the polymerisation and/or the crosslinking of the ink. Thus, the ink is fixed and in a solid, stable and irreversible state. As an example, inks of the ALTAMIRA DESIGN DP® range, commercialised by the Company AGFA, or inks of the UVIJET KO® range of the Company FUJIFILM can be used for printing by inkjet. The ink chosen also has a certain malleability after polymerisation, as well as a chemical nature allowing to both not crack during the deformation of the transfer film 12 and to not be denatured in contact with the resin 13.

In the case of screen printing, screens comprising holes of a diameter comprised between 10 and 100 μm, typically 40 μm, are disposed facing the transfer film 12. The linear resolution is comprised between 50 and 150 dpi, typically 120 dpi, that is around 15000 drops per square, of which the sides are 2.54 cm, that is around 2300 drops per $cm^2$.

The liquid ink passes through the holes and creeps lightly arriving on the transfer film 12. The ink contains a solvent which can evaporate either at ambient temperature, or in an oven. The ink polymerises and/or is crosslinked by inputting external energy, typically under the effect of ambient humidity, of exposure to light or under the effect of an increase in temperature, to be found irreversibly in a stable, solid state.

In principle, the thickness of the ink layer deposited by inkjet is around 5 to 6 μm while the thickness of the ink layer deposited by screen printing is a little thicker, that is around 10 μm.

It is generally easier to create large surfaces evenly decorated with screen printing than with inkjet. With a printing by inkjet, it will be necessary to affix several ink layers to obtain a similar result.

Such as illustrated in FIG. 6, the ink layer can be composed of one single pass of ink grains 11 of a first type. The ink grains 11 are generally deposited regularly on the surface of the transfer film 12.

Such as illustrated in FIG. 7, the ink layer can be composed of several passes of ink grains 11, 21 of several types.

Figure 8:
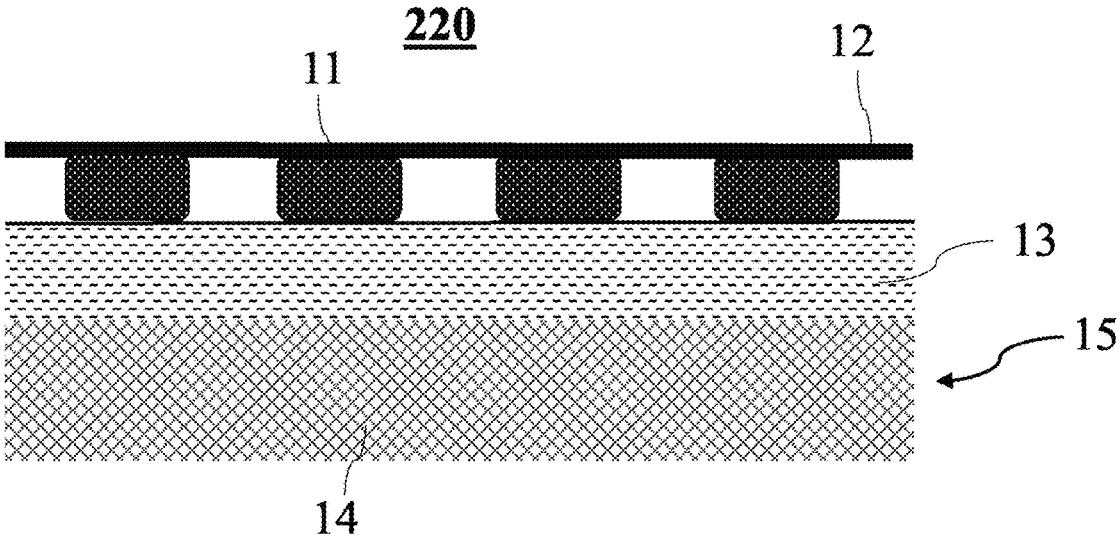
FIG. 8 is a cross-sectional representation of the film applied to the surface of the resin, during the second step of the method of FIG. 3.

In any case, the ink and the surface state, i.e. the roughness of the transfer film 12 are chosen for having a mutual adhesion force allowing to hold the pattern in place on the transfer film 12, without migration during the movement and positioning of the transfer film 12 on the surface of the resin, all the more so the decorated face of the transfer film 12 is oriented downwards during the moulding of the board. However, the adhesion force between the ink and the transfer film 12 is preferably weaker than the adhesion force between the ink and the resin 13 for impregnating the composite to facilitate the detachment of the grains 11, 21 from the transfer film 12 and their attachment to the resin 13. Such as illustrated in FIG. 8, step 220 of the method consists of depositing the transfer film 12 to the surface of the resin 13 of the composite 15. In principle, the pattern is mirror-printed on the transfer film 12 such that, when the transfer film 12 is returned on the resin 13, the pattern is in the desired orientation, for example legible in the case of a written document.

Figure 9:
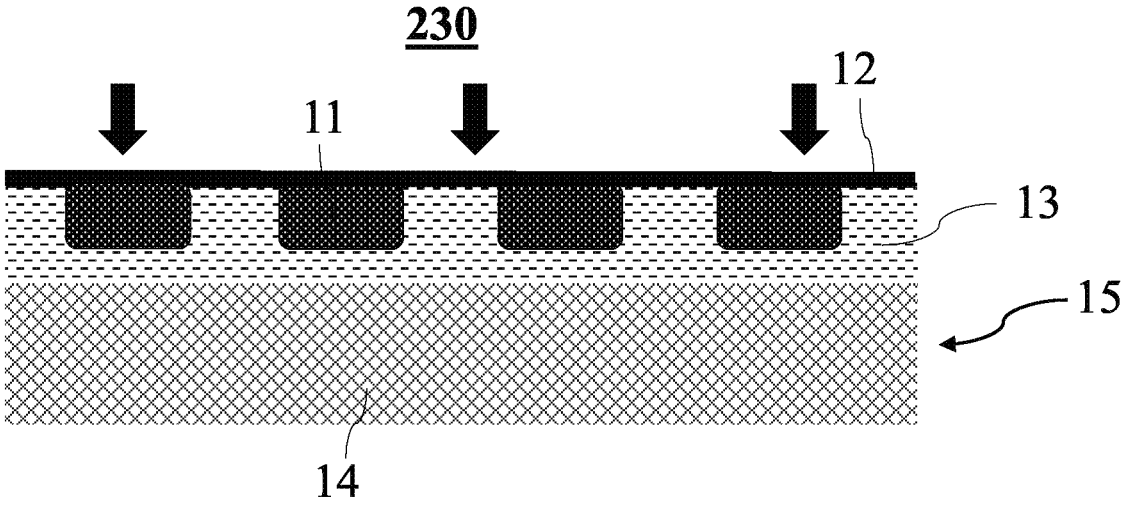
FIG. 9 is a cross-sectional representation of the film positioned on the surface of the resin, after application of the pressure and temperature conditions during the third step of the method of FIG. 3.

Such as illustrated in FIG. 9, in step 230, pressure and temperature conditions, typically comprised between 3 and 10 bars and 80 and 120° C., are applied on the composite 15 covered with the printed transfer film 12. In the case of a simple transfer of décor on a composite 15, without problems with gluing different elements together, a pressure greater than or equal to 3 bars is sufficient. This can be applied for example when the composite 15 is decorated prior to the assembly of the ski in a mould.

Furthermore, the transfer temperatures described above are compatible with the use of polyethylene-type materials, generally constituting the sliding soles of the skis. In the extreme, the temperature can even be ambient temperature, but the hardening time of the resin is thus a lot longer.

For a thermoplastic resin 13, this is in the solid state before the pressure and temperature conditions are applied on the sliding board. The increase in pressure and in temperature allows to soften the thermoplastic resin 13. It is in this phase that the grains 11 in the solid state composing the décor will be incrusted in the softened resin 13. Then, the cooling phase allows the return of the assembly formed by the resin 13 incrusted with grains 11 in the solid state.

In the case of a thermosetting resin 13, this is in the liquid state. It is in this phase that the grains 11 in the solid state composing the décor will be incrusted in the liquid resin 13. The increase in pressure and in temperature allows to harden the thermosetting resin 13 around the grains 11.

In any case, the resin 13 in the liquid state during the moulding fills all the free spaces left by the ink grains 11 from the fibrous reinforcement 14, to the surface of the sliding board, before hardening, either by crosslinking, or by cooling, according to the nature of resin used.

Figure 10:
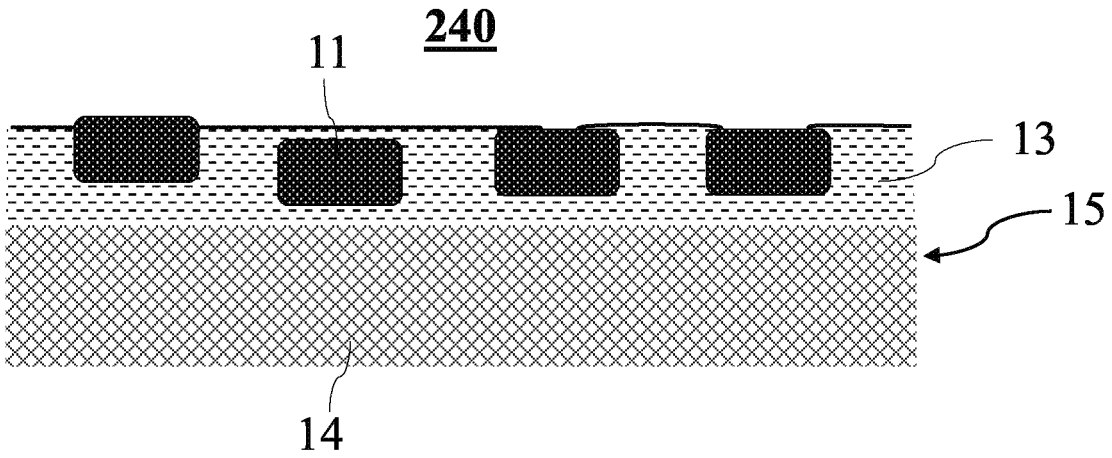
FIG. 10 is a cross-sectional representation of the upper portion of the sliding board once the transfer film is peeled during the fourth step of the method of FIG. 3.

FIG. 10 illustrates step 240 of the method in which the transfer film 12 is peeled from the solid surface of the composite 15.

In the case of manufacturing a ski, the composite 15 is generally impregnated beforehand, then transferred into the mould with the other components constituting the ski. The application of the pressure and temperature conditions allows to agglomerate the different constitutive layers of the ski, as well as hardening the resin. In this case, 6 to 10 bars, and preferably 8 bars are preferably applied on the mould. This pressure further allows to repel the excess resin and to obtain a composite 15 having a resin rate comprised between 15 and 30%, typically 20%. In a variant, the composite 15 can also be impregnated with resin directly in the mould.

Moreover, the transfer of the pattern in the composite 15 can be done in several ways. A first method consists of applying the transfer film 12 on the composite 15 after its placement in the mould. A second method consists of applying the transfer film 12 beforehand on the composite 15, then to transfer the assembly formed by the impregnated composite 15 and the transfer film 12 in the mould. The pressure and temperature conditions applied to the mould then allowing the transfer of the pattern from the transfer film 12 to the superficial resin layer 13.

In the case of a thermoplastic resin, it can also be devised to perform the transfer of the pattern into the composite 15 before moulding. To do this, pressure and temperature conditions allowing the softening of the thermoplastic resin must be applied beforehand on the assembly formed by the impregnated composite 15 and the transfer film 12. Subsequently, during moulding, the thermoplastic resin can nonetheless be softened, while conserving the pattern such as transferred.

To conclude, the disclosed embodiments advantageously allow to obtain a sliding board with a clean décor, not having any or few deformations and which resists external aggressions. The method for manufacturing such a sliding board is versatile and allows to obtain multiple decors with a lot of contrast and without limitation in terms of colours. Moreover, according to the ink grain coverage rate of the resin, the touch can be modified to improve the gripping of the sliding board.

The invention claimed is:

1. A method for decorating a sliding board including, on a visible part of the sliding board, a composite material formed of a fibrous layer impregnated with and coated with hardenable resin forming a superficial layer of the composite material, said method comprising the following steps:

preparing a transfer film comprising a face covered with a pattern constituted of an arrangement of grains of at least one type of ink, said ink comprising colourants and a crosslinked polymer, positioning the face of the transfer film covered with the pattern on all or some of the external surface of the composite material, applying pressure and temperature conditions that (1) harden or (2) soften then harden the resin so as to incrust at least partially the grains of the pattern in the superficial layer of the composite material while conserving the arrangement of the grains prepared on the transfer film, and peeling the transfer film.

2. A decoration method according to claim 1, further comprising a step of positioning the composite material in a mould, the pressure and temperature conditions being applied on said mould.

3. A decoration method according to claim 1, wherein the method further comprises a step of crosslinking the polymer composing the ink.

4. A decoration method according to claim 1, wherein the temperature generating the softening or, if no softening, the hardening of the resin is less than or equal to 120° C.

5. A decoration method according to claim 1, wherein the transfer film is deformable such that the transfer film can be folded and/or stretched to be adapted to the three-dimensional geometry of the external surface of the composite material.

6. A decoration method according to claim 1, wherein the transfer film is made of a material chosen from among polyolefins.

7. A decoration method according to claim 1, wherein the adhesion force between the ink grains and the resin is greater than the adhesion force between the ink grains and the transfer film.

8. A decoration method according to claim 1, wherein a softening temperature of the transfer film is greater than the temperature conditions that (1) harden or (2) soften then harden the resin.

* * * * *